US008585425B2

(12) United States Patent
Yeh

(10) Patent No.: US 8,585,425 B2
(45) Date of Patent: Nov. 19, 2013

(54) FIXING STRUCTURE WITH INTERFACE CARD MODULE AND FIXING STRUCTURE THEREOF

(75) Inventor: Chun-Yen Yeh, Taipei (TW)

(73) Assignee: Inventec Corporation, Taipei (TW)

( * ) Notice: Subject to any disclaimer, the term of this patent is extended or adjusted under 35 U.S.C. 154(b) by 88 days.

(21) Appl. No.: 13/333,804

(22) Filed: Dec. 21, 2011

(65) Prior Publication Data

US 2013/0109217 A1 May 2, 2013

(30) Foreign Application Priority Data

Nov. 2, 2011 (TW) ..... 100140022 A

(51) Int. Cl.
*H01R 13/62* (2006.01)

(52) U.S. Cl.
USPC ..... 439/327; 439/325

(58) Field of Classification Search
USPC ..... 439/325–328
See application file for complete search history.

(56) References Cited

U.S. PATENT DOCUMENTS

| | | | | |
|---|---|---|---|---|
| 4,198,024 | A * | 4/1980 | Cavanna | 248/544 |
| 4,938,701 | A * | 7/1990 | Heberling | 439/65 |
| 5,494,451 | A * | 2/1996 | Bowers | 439/328 |
| 8,113,862 | B2 * | 2/2012 | Wei | 439/326 |
| 2008/0096412 | A1 * | 4/2008 | Poh et al. | 439/326 |

* cited by examiner

*Primary Examiner* — Thanh Tam Le
(74) *Attorney, Agent, or Firm* — Maschoff Brennan

(57) ABSTRACT

A fixing structure with an interface card module comprises a fixing structure and an interface card module. The fixing structure includes a main board, a connector and a fixing frame. The main board has an edge. The connector is disposed on the main board, and the connector has a socket which faces toward the edge. The fixing frame has a connecting end and a fixing end opposite to each other, the fixing frame is disposed on the main board via the connecting end and the fixing end is protruded outside the edge. The interface card module has a first end and a second end opposite to each other, the first end is inserted into the socket, and the second end is protruded outside the edge and is fixed at the fixing end. Therefore, the interface card module is fixed on the main board.

8 Claims, 4 Drawing Sheets

FIXING STRUCTURE WITH INTERFACE CARD MODULE AND FIXING STRUCTURE THEREOF

CROSS-REFERENCE TO RELATED APPLICATIONS

This non-provisional application claims priority under 35 U.S.C. §119(a) on Patent Application No(s). 100140022 filed in Taiwan, R.O.C. on Nov. 2, 2011, the entire contents of which are hereby incorporated by reference.

BACKGROUND

1. Technical Field

The present disclosure relates to a fixing structure with an interface card module and a fixing structure thereof, and more particularly to the fixing structure with the interface card module and the fixing structure thereof having a fixing frame.

2. Related Art

In recent years, with the rapid development of technology and convenient access of information, manufacturing techniques of electronic products are improved. Electronic products are developed with characteristics of lightness and compactness in responding to the demands of portability and practicability from consumers. Take computer as an example, a laptop is developed from a desktop computer, and a compact laptop commonly found in the market is evolved from a bulky sized laptop of the early stage.

Because of the limited space inside the laptop, there are distinct differences of internal electronic components fixing structures between the laptop and the desktop. Take interface card of desktop as an example, the interface card is fixed vertically to a motherboard on a frame of the computer case, and the space occupied by the interface card is seldom taken into consideration. As for interface card of laptop, the interface card is disposed flatly on a motherboard of the laptop, so that a limited internal space of the laptop can be saved.

More specifically, the interface card of the laptop can be locked and fixed on the motherboard by screws. Because the interface card is disposed flatly on the motherboard of the laptop, an area of the motherboard underneath the interface card is wasted. In order to tackle the above-mentioned problem, another way of fixation is developed by having an end of the interface card inserted onto the motherboard and another end fixed on a case of the laptop, thus the area of the motherboard can be utilized more wisely with a higher utilization percentage.

The two ends of the above-mentioned interface card are connected and fixed on the motherboard and the case respectively, relative displacements between the case and the motherboard will be occurred due to slight elastic deformation of the case when the laptop is impacted by an external force, and an offset of the two ends of the interface card is caused. As a result, a connector for inserting the interface card has a problem with stress concentration, thus a life expectancy of the connector is reduced.

SUMMARY

The disclosure provides a fixing structure with an interface card module and the fixing structure thereof, in order to solve the problems that an interface card being pulled due to relative displacements between a case and a motherboard, and results in a life expectancy of a connector for inserting the interface card being reduced.

The present disclosure relates to a fixing structure with an interface card module includes a main board, a connector, a fixing frame and an interface card module. The main board has an edge. The connector is disposed on the main board, and the connector has a socket which faces toward the edge. The fixing frame has a connecting end and a fixing end opposite to each other, the fixing frame is disposed on the main board via the connecting end and the fixing end is protruded outside the edge. The interface card module has a first end and a second end opposite to each other, the first end is inserted into the socket, and the second end is protruded outside the edge. The second end of the interface card module is fixed at the fixing end, so that the interface card module is securely fixed on the main board.

The present disclosure relates to a fixing structure applicable for fixing an interface card module. The interface card module has a first end and a second end opposite to each other, the fixing structure includes a main board, a connector and a fixing frame. The main board has an edge. The connector is disposed on the main board, and the connector has a socket which faces toward the edge. The socket is for the first end of the interface card module to insert into. The fixing frame has a connecting end and a fixing end opposite to each other, the fixing frame is disposed on the main board via the connecting end and the fixing end is protruded outside the edge. The fixing end is for fixing the second end of the interface card module, so that the interface card module is securely fixed on the main board.

According to the present disclosure, the fixing frame is disposed on the main board, and the interface card module is fixed by the fixing end of the fixing frame which is protruded outside the edge of the main board, so that the interface card module can be securely disposed on the main board. Therefore, an area of the main board can be avoided from overly occupied by the interface card module, and the main board area can be utilized with a higher utilization percentage. Furthermore, the problem of stress concentrated effect on the connector caused by the fixing structure with the interface card module being impacted by an external force can be avoided, thus the problem of reduced life expectancy of the connector caused by conventional fixing methods can be improved.

The present disclosure will become more fully understood by reference to the following detailed description thereof when read in conjunction with the attached drawings.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION

Figure 1:
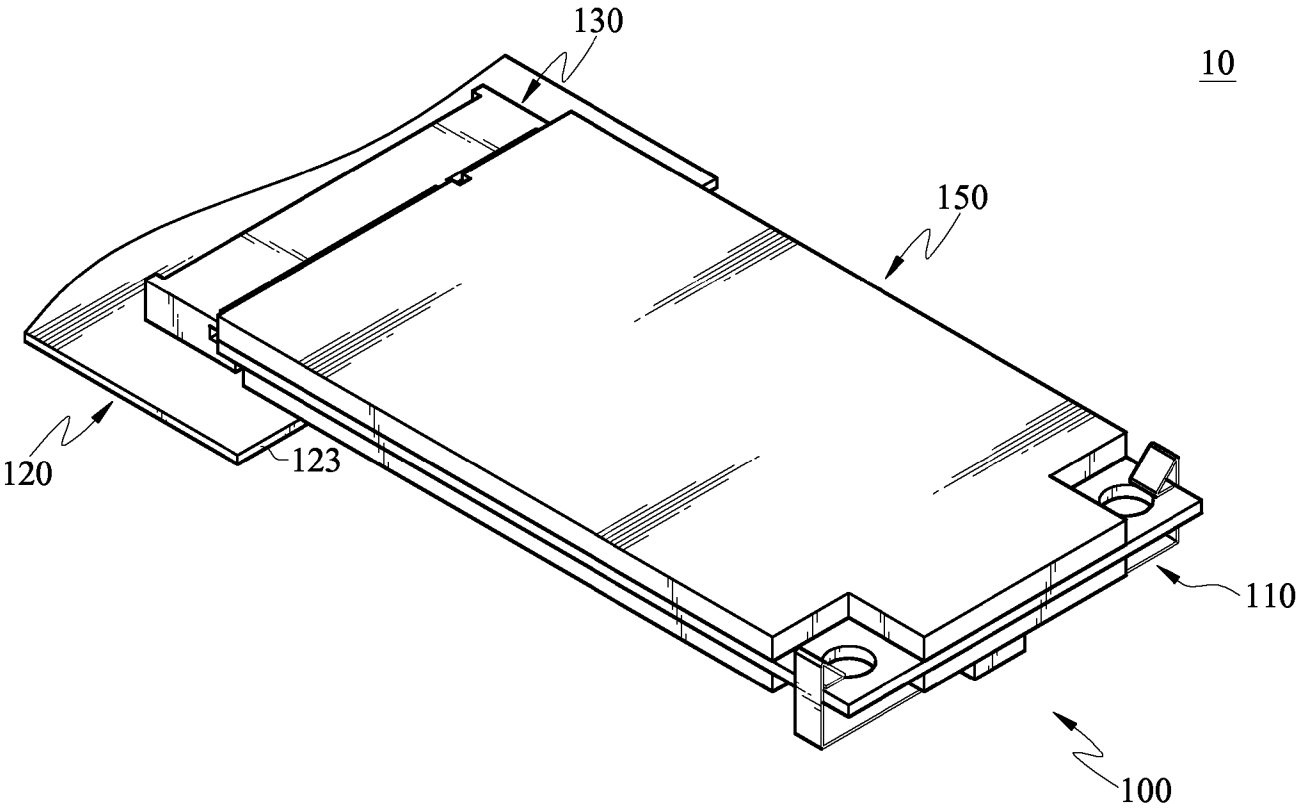
FIG. 1 is a schematic view of a fixing structure with an interface card module of an embodiment according to the disclosure.
Figure 2:
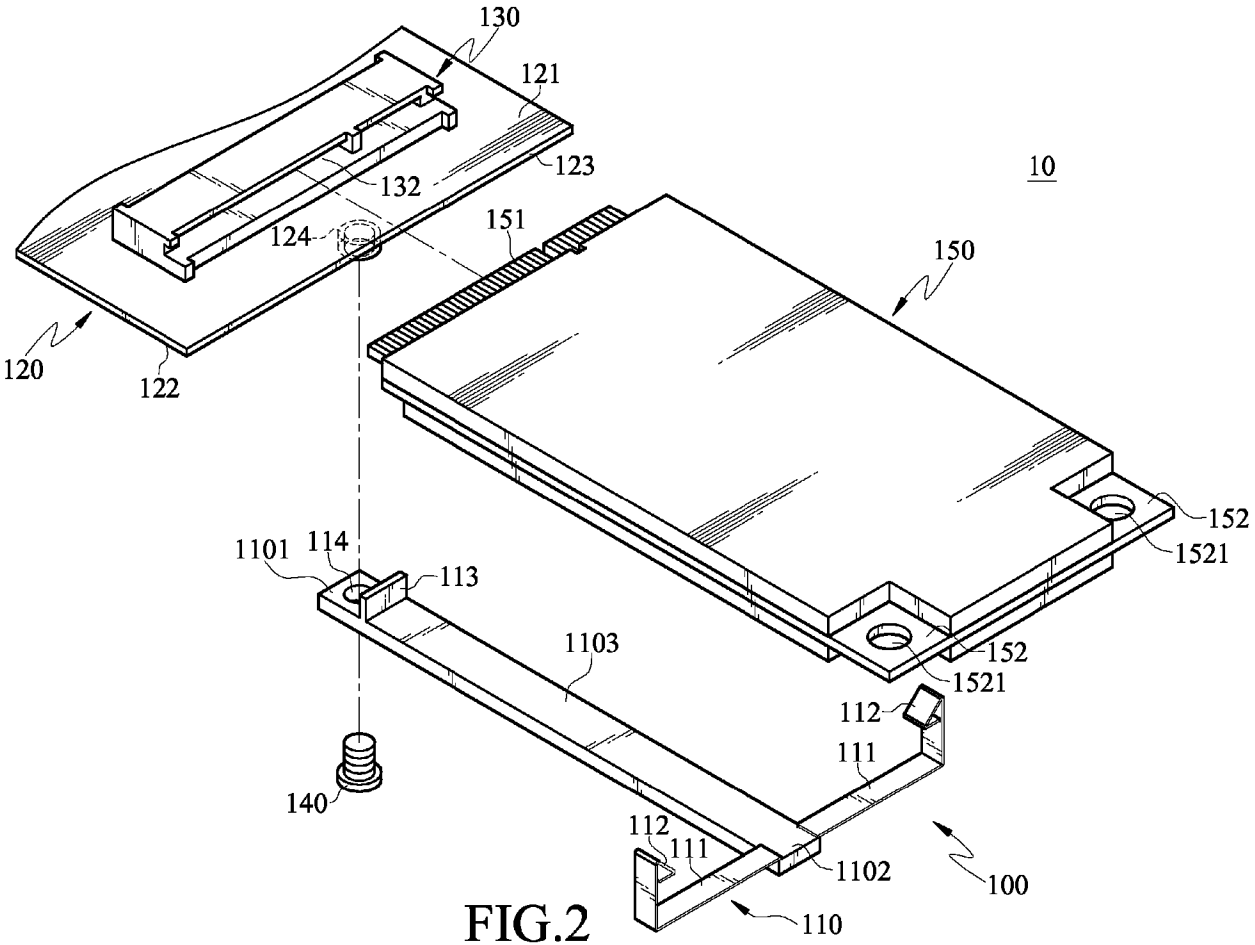
FIG. 2 is an exploded perspective view of a fixing structure with an interface card module of an embodiment according to the disclosure.

Referring to FIGS. 1 and 2, FIG. 1 is a schematic view of a fixing structure with an interface card module of an embodiment according to the disclosure, while FIG. 2 is an exploded perspective view of a fixing structure with an interface card module of an embodiment according to the disclosure.

A fixing structure with an interface card module 10 of this embodiment includes a fixing structure 100 and an interface card module 150. An interface card inside a laptop is used as an example for the interface card module 150, such as a Bluetooth module, a wireless module or an antenna module, etc., but it is not limited to the above-mentioned modules. Furthermore, the interface card module 150 has a first end 151 and a second end 152 opposite to each other.

The fixing structure 100 includes a main board 120, a connector 130 and a fixing frame 110. The main board 120 of this embodiment can be, but not limited to a motherboard, the main board 120 has an edge 123. The connector 130 is disposed on the main board 120, and the connector 130 has a socket 132 which faces toward the edge 123 of the main board 120. The socket 132 of the connector 130 is for the first end 151 of the interface card module 150 to insert into, so that the interface card module 150 and the connector 130 are electrically connected to each other.

In this embodiment, the fixing frame 110 has a connecting end 1101 and a fixing end 1102 opposite to each other. The fixing frame 110 is disposed on the main board 120 via the connecting end 1101, and the fixing end 1102 is protruded outside the edge 123 of the main board 120. The fixing end 1102 is for fixing the second end 152 of the interface card module 150, so that the interface card module 150 can be securely disposed on the main board 120.

More specifically, when the fixing frame 110 is disposed on the main board 120, the fixing end 1102 of fixing frame 110 is protruded and suspended outside the edge 123 of the main board 120 in a cantilever way. When the first end 151 of the interface card module 150 is inserted into the socket 132, the second end 152 of the interface card module 150 is protruded outside the edge 123 of the main board 120 and is connected with the fixing end 1102 of the fixing frame 110. Therefore, a part of the interface card module 150 protruded outside the edge 123 of the main board 120 can be supported and fixed by the fixing frame 110, and the two opposite ends of the interface card module 150 can be connected with the fixing frame 110 and the connector 130 respectively, thus an effect of the interface card module 150 being securely disposed on the main board 120 can be achieved. Accordingly, by the above-mentioned assembling method of the interface card module 150 and the fixing structure 100, an area of the main board 120 can be avoided from overly occupied by the interface card module 150, so the area of the main board 120 can be utilized with a higher utilization percentage. Furthermore, because the fixing frame 110 is fixed on the main board 120, when the fixing structure with the interface card module 10 is impacted by an external force, relative offset displacements between the fixing frame 110 and the main board 120 will less likely to occur. Therefore, when the fixing structure with the interface card module 10 is impacted by the external force, the problem of stress concentrated effect on the connector 130 caused by offset displacements of the two oppositely ends of the interface card module 150 can be avoided, thus the problem of reduced life expectancy of the connector 130 can be improved.

Continue to refer to FIGS. 1 and 2. Moreover, the main board 120 has a first surface 121 and a second surface 122 opposite to each other, the connector 130 is disposed on the first surface 121, and the fixing frame 110 is disposed on the second surface 122. In other words, the connector 130 and the fixing frame 110 are disposed on the two opposite surfaces of the main board 120.

Furthermore, the fixing frame 110 has a supporting surface 1103, and the interface card module 150 is disposed on the supporting surface 1103. A through hole 114 and a limiting element 113 are disposed on the supporting surface 1103 near the connecting end 1101. In addition, a tapped hole 124 is disposed on the second surface 122 of the main board 120, and the tapped hole 124 corresponds to the through hole 114. The fixing structure with the interface card module 10 of this embodiment further includes a locking element 140, the locking element 140 can be, but not limited to a screw. The locking element 140 engages with the through hole 114 and is fastened in the tapped hole 124, so that the connecting end 1101 of the fixing frame 110 is fixed on the main board 120.

Furthermore, when the fixing frame 110 is locked and fixed on the main board 120 by the locking element 140, the limiting element 113 is pressed against the edge 123 of the main board 120. Therefore, a horizontal displacement of the fixing frame 110 relative to the main board 120 is limited by the locking element 140, and a rotational displacement of the fixing frame 110 relative to the main board 120 is limited by the limiting element 113 being pressed against the edge 123, so that the fixing frame 110 can be securely disposed on the main board 120. When the limiting element 113 is pressed against the edge 123 of the main board 120, the limiting element 113 is not protruded outside the first surface 121 of the main board 120, in order to avoid the interference effect between the limiting element 113 and the interface card module 150.

Continue to refer to FIGS. 1 and 2. In this embodiment, the fixing end 1102 of the fixing frame 110 has two hooks 112, and the fixing end 1102 of the fixing frame 110 clips on the second end 152 of the interface card module 150 by the two hooks 112. More specifically, an arm 111 is extended from each of two opposite sides of the fixing end 1102 of the fixing frame 110 respectively, and the hooks 112 are formed by bending an end of each of the arms 111 toward a direction the supporting surface 1103 faced. The two hooks 112 are disposed facing to each other, and the two hooks 112 are clipped on two opposite sides of the second end 152 of the interface card module 150 respectively, so that the interface card module 150 and the fixing frame 110 are fixed with each other. A main body of the fixing frame 110 can be made of plastic, and the arms 111 and the hooks 112 can be made of metal, so that the fixing frame 110 can be both cost effective and has a long life expectancy by using different materials for different portions of the fixing frame 110.

In another embodiment, a part of the hooks 112 are inserted into the a hole 1521 of the second end 152 of the interface card module 150 respectively.

The material of the fixing frame 110 should not be construed as a limitation to the disclosure thereof. In another embodiment of the disclosure, the main part of the fixing frame 110, the arms 111 and the hooks 112 can be made of metal or plastic alone.

Figure 3:
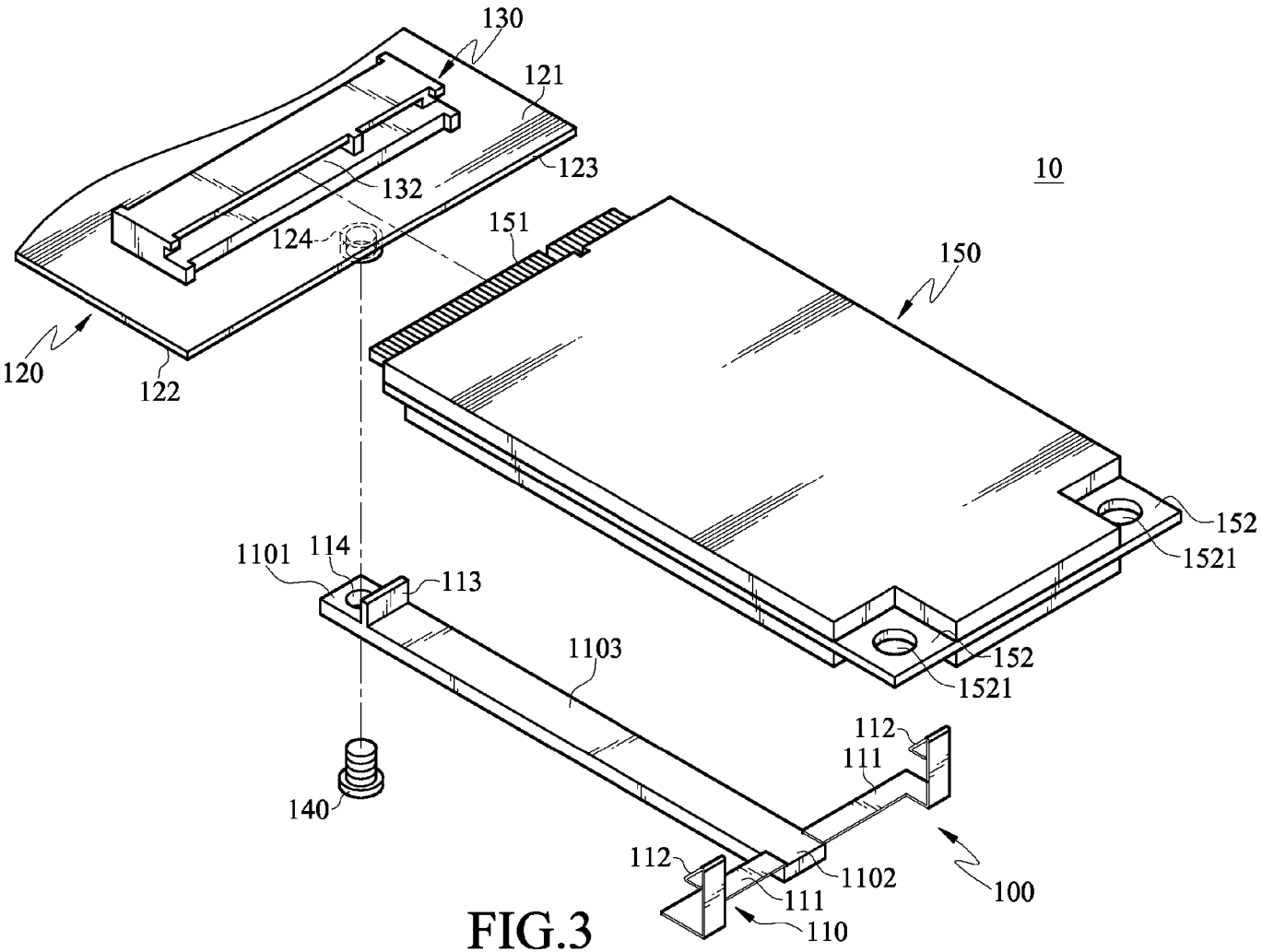
FIG. 3 is an exploded perspective view of a fixing structure with an interface card module of another embodiment according to the disclosure.

The characteristic of the two hooks 112 of this embodiment clipping on the two opposite sides of the second end 152 of the interface card module 150 respectively should not be construed as a limitation to the disclosure thereof. For example, in another embodiment of the disclosure, the two hooks 112 can also clip on a same side of the second end 152 of the interface card module 150 as shown in FIG. 3. FIG. 3 is an exploded perspective view of a fixing structure with an interface card module of another embodiment according to the disclosure.

Furthermore, a disposing of two of the hooks 112 for the fixing frame 110 in the above-mentioned embodiment is merely used as an example. However, the number of the hooks 112 should not be construed as a limitation to the disclosure thereof. In another embodiment of the disclosure, the number of the hook 112 can be one.

Furthermore, the disposing of the hooks 112 for the fixing end 1102 of the fixing frame 110 of the above-mentioned embodiment for fixing the interface card module 150 is merely used as an example, however, the way the interface card module 150 fixed by the fixing end 1102 is not limited to using the hooks 112. For example, the interface card module 150 can be locked and fixed by the fixing end 1102 by the screws.

Figure 4:
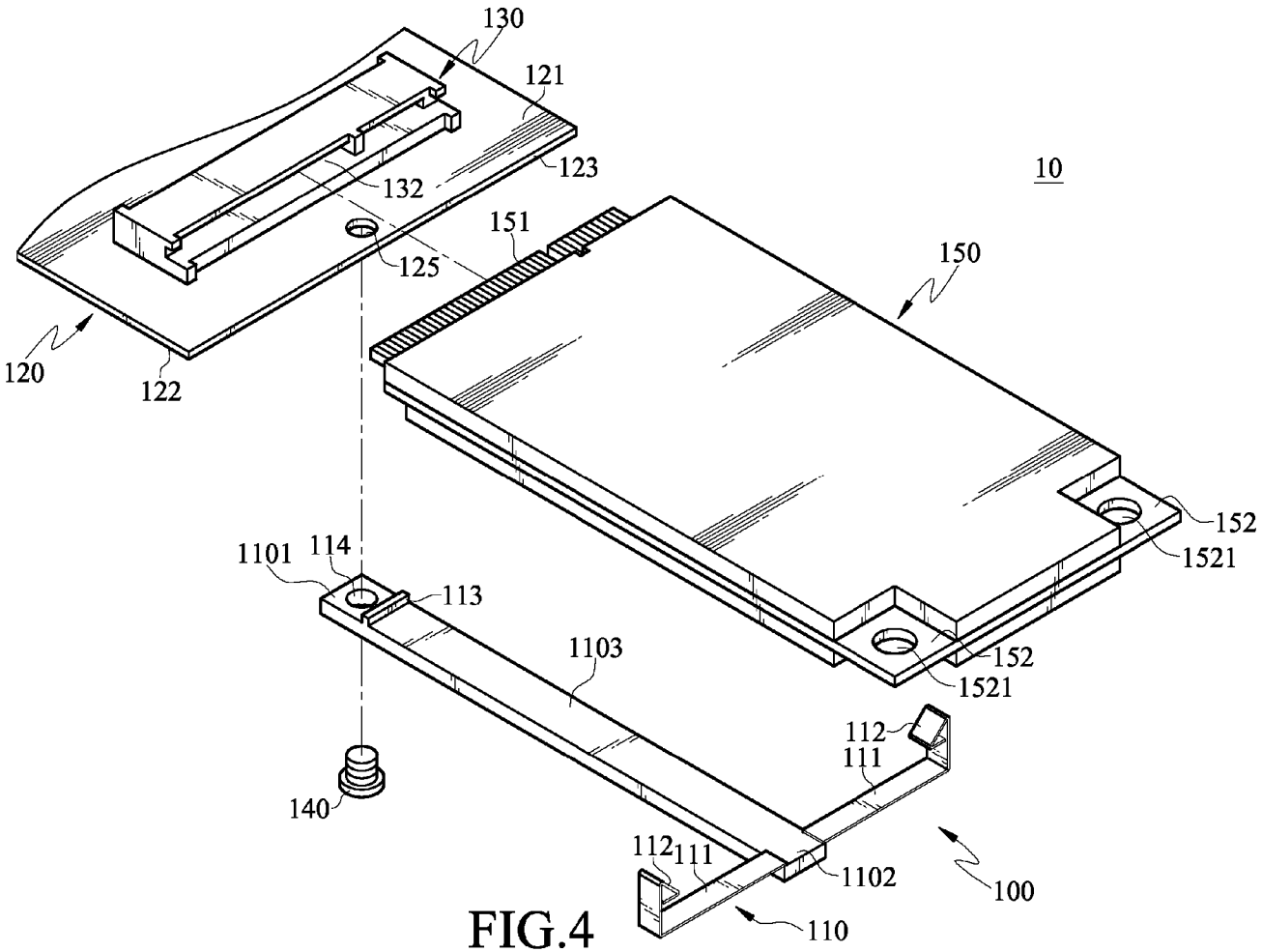
FIG. 4 is an exploded perspective view of a fixing structure with an interface card module of yet another embodiment according to the disclosure.

Furthermore, in this embodiment, by using the locking element 140 to engage with the through hole 114 to be fastened in the tapped hole 124, so that the connecting end 1101 of the fixing frame 110 can be fixed on the main board 120. However, the characteristic of the tapped hole 124 disposing on the main board 120 should not be construed as a limitation to the disclosure thereof. For example, in another embodiment of the disclosure, a screw hole 125 can be directly disposed on the main board 120 to replace the original tapped hole 124, and the locking element 140 can engage with the through hole 114 to be fastened in the screw hole 125, so that the connecting end 1101 of the fixing frame 110 can also be securely fixed on the main board 120 as shown in FIG. 4. FIG. 4 is an exploded perspective view of a fixing structure with an interface card module of yet another embodiment according to the disclosure.

According to a fixing structure with an interface card module and fixing structure thereof of the above-mentioned embodiment, the fixing frame is disposed on the main board, and the interface card module is fixed by the fixing end of the fixing frame which the fixing end is protruded outside the edge of the main board, so that the interface card module can be securely disposed on the main board. Therefore, the area of the main board can be avoided from overly occupied by the interface card module, so that the main board area can be utilized with a higher utilization percentage. Furthermore, the problem of relative offset effect will less likely to occur by having the fixing frame fixed directly on the main board, and the problem of stress concentrated effect on the connector caused by the fixing structure with the interface card module being impacted by an external force can be avoided, thus the problem of reduced life expectancy of the connector caused by conventional fixing methods can be improved.

Note that the specifications relating to the above embodiments should be construed as exemplary rather than as limitative of the present disclosure, with many variations and modifications being readily attainable by a person of average skill in the art without departing from the spirit or scope thereof as defined by the appended claims and their legal equivalents.

What is claimed is:

1. A fixing structure with an interface card module, comprising:

a main board having an edge;

a connector disposed on the main board, the connector having a socket, the socket facing toward the edge;

a fixing frame having a connecting end and a fixing end opposite to each other, the fixing frame being disposed on the main board via the connecting end, the connector and the fixing frame being located on two opposite surfaces of the main board respectively, and the fixing end being protruded outside the edge; and an interface card module having a first end and a second end opposite to each other, the first end being inserted into the socket, the second end being protruded outside the edge, the second end of the interface card module being fixed by the fixing end, and the interface card module being securely fixed on the main board.

2. The fixing structure with the interface card module as claimed in claim 1, wherein the fixing end of the fixing frame has at least one hook, the hook is clipped on the second end of the interface card module.

3. The fixing structure with the interface card module as claimed in claim 1, wherein the fixing end of the fixing frame has two hooks, the two hooks are clipped on two opposite sides of the second end of the interface card module respectively.

4. The fixing structure with the interface card module as claimed in claim 1, wherein the fixing end of the fixing frame has two hooks, the two hooks are clipped on a same side of the second end of the interface card module.

5. The fixing structure with the interface card module as claimed in claim 1, further comprising a locking element, the connecting end of the fixing frame having a through hole and a limiting element, the locking element engaging with the through hole and fastening the fixing frame on the main board, the limiting element being pressed against the edge so that the connecting end being fixed on the main board.

6. A fixing structure for fixing an interface card module, the interface card module having a first end and a second end opposite to each other, the fixing structure comprising:

a main board having an edge;

a connector disposed on the main board, the connector having a socket, the socket facing toward the edge; the socket being applicable for the first end of the interface card module to be inserted into; and a fixing frame having a connecting end and a fixing end opposite to each other, the fixing frame being disposed on the main board via the connecting end, the connector and the fixing frame being located on two opposite surfaces of the main board respectively, the fixing end being protruded outside the edge, the fixing end being applicable for fixing the second end of the interface card module, and the interface card module being fixed on the main board.

7. The fixing structure as claimed in claim 6, wherein the fixing end of the fixing frame has a hook, the fixing end is applicable for clipping on the interface card module by the hook.

8. The fixing structure as claimed in claim 6, further comprising a locking element, the connecting end of the fixing frame having a through hole and a limiting element, the locking element engaging with the through hole and fastening the fixing frame on the main board, the limiting element being pressed against the edge and the connecting end being fixed on the main board.

* * * * *